US008215217B2

(12) United States Patent
Aigner

(10) Patent No.: US 8,215,217 B2
(45) Date of Patent: Jul. 10, 2012

(54) APPARATUS FOR MOUNTING A STOP RULE ON THE MACHINE TABLE OF A TABLE SAW

(76) Inventor: Georg Aigner, Reisbach (DE)

( * ) Notice: Subject to any disclaimer, the term of this patent is extended or adjusted under 35 U.S.C. 154(b) by 530 days.

(21) Appl. No.: 12/514,720

(22) PCT Filed: Aug. 27, 2008

(86) PCT No.: PCT/EP2008/061199

§ 371 (c)(1),
(2), (4) Date: Jun. 6, 2009

(87) PCT Pub. No.: WO2010/006660

PCT Pub. Date: Jan. 21, 2010

(65) Prior Publication Data

US 2010/0313727 A1 Dec. 16, 2010

(30) Foreign Application Priority Data

Jul. 15, 2008 (DE) ..... 20 2008 009 485 U

(51) Int. Cl.
*B27B 3/28* (2006.01)

(52) U.S. Cl. ..... 83/409; 83/477.2

(58) Field of Classification Search ..... 83/409, 83/425, 437.1, 2, 437.6, 435.11–435.21, 83/438, 446, 477.2, 435.25, 109, 162; 403/300, 403/301

See application file for complete search history.

(56) References Cited

U.S. PATENT DOCUMENTS

| | | | | |
|---|---|---|---|---|
| 2,594,651 | A * | 4/1952 | Jackson | 83/471.2 |
| 3,130,622 | A * | 4/1964 | Eno | 83/529 |
| 3,302,669 | A * | 2/1967 | Edler | 83/471.3 |
| 4,712,462 | A * | 12/1987 | Cvek | 83/762 |
| 5,040,443 | A * | 8/1991 | Price | 83/468 |
| 5,275,074 | A * | 1/1994 | Taylor et al. | 83/425 |
| 5,735,054 | A * | 4/1998 | Cole | 33/471 |
| 6,817,275 | B1 * | 11/2004 | Chin-Chin | 83/435.11 |
| 7,000,519 | B1 * | 2/2006 | Weinstein et al. | 83/435.27 |
| 7,540,224 | B2 * | 6/2009 | Wang | 83/436.2 |
| 7,546,790 | B2 * | 6/2009 | Parks et al. | 83/468.3 |
| 7,614,329 | B2 * | 11/2009 | Aigner | 83/437.2 |
| 2002/0104417 | A1 * | 8/2002 | Chen | 83/435.14 |
| 2004/0154449 | A1 * | 8/2004 | Parks et al. | 83/477.2 |
| 2007/0084323 | A1 * | 4/2007 | Parks et al. | 83/468.3 |
| 2008/0092707 | A1 | 4/2008 | Aigner | |
| 2011/0061508 | A1 * | 3/2011 | Scherl | 83/438 |

FOREIGN PATENT DOCUMENTS

WO 2008138745 11/2008

* cited by examiner

*Primary Examiner* — Sean Michalski
(74) *Attorney, Agent, or Firm* — Themis law

(57) ABSTRACT

The invention relates to an apparatus for mounting a stop rule on a machine table of a table saw by means of an adapter. In one embodiment, the adapter includes on one side a clamping bar protruding from a plate for engagement into a longitudinal groove of the stop rule, and on the opposite side means for connection to a clamping element of a rule carrier attached to the machine table. The plate of the adapter carrying the clamping bar is supported between two columns that are fastenable on the rule carrier, and carries on its back side, facing the rule carrier, a vertically adjustable clamping plate for coupling the clamping element of the rule carrier fixedly against the back side of the plate. The clamping plate is connected to the adapter plate via two releasable screws that are vertically adjustable in two vertical elongated holes of the plate.

7 Claims, 7 Drawing Sheets

APPARATUS FOR MOUNTING A STOP RULE ON THE MACHINE TABLE OF A TABLE SAW

FIELD OF THE INVENTION

The invention relates to an apparatus for mounting a stop rule on the machine table of a table saw by means of an adapter, which includes on one side a clamping bar, protruding from a plate, for engagement into a longitudinal groove of the stop rule, and on the oppositely located side means for connection to a clamping element of a rule carrier attached to the machine table.

BACKGROUND OF THE INVENTION

The subject matter of the Applicant's patent application EP 1 851 017 A1 is a stop rule for table saws, which includes a hollow profile, extending in a longitudinal direction, that can be used in a laid-down position for the processing of narrow workpieces, and in an upright position for the sawing of thicker workpieces. For advancing the workpieces, a slide to be actuated from outside is supported in the hollow profile, from which slide protrude two follower fingers, offset at a 90-degree angle, that project beyond the guidance limb of the hollow profile.

In an embodiment of this stop rule, an adapter is provided so that the hollow profile can be attached onto a wide variety of rule carriers. Attached for this purpose on the back side (facing toward the rule carrier) of the plate of the adapter are two bars, L-shaped in cross section, that can be secured at different heights by means of screws. Leaving aside the fact that installation of these bars is relatively complicated, which is a disadvantage especially when changing the rule carrier, with this adapter it is not possible to accommodate all commercially usual rule carriers, whose clamping elements can exhibit a very wide variety of dimensions and positions on the rule carrier.

SUMMARY OF THE INVENTION

It is an object of the invention to overcome the above described drawbacks and to provide an apparatus that includes an adapter adapting in a simple and quick manner to the respective clamping element of a rule carrier and that can be used even with rule carriers, in which the clamping element is located at extreme vertical positions.

To achieve this object, according to the invention a plate coupled to the clamping bar of the adapter is supported between two columns that are fastenable on the rule carrier and carries on its back side, facing the rule carrier, a vertically adjustable clamping plate for fixedly clamping the clamping element of the rule carrier against the back side of the plate.

In another embodiment of the invention, the clamping plate is connected to the plate of the adapter with two releasable screws that are guided in vertically adjustable fashion within two vertical elongated holes of the plate.

Because the position of the clamping plate can be varied, an apparatus according to the present invention may encompass clamping elements that rest with their lower edge at table height. A vertical adjustment of the clamping plate requires merely that the two screws be loosened. Because these screws are releasable, according to another feature of the present invention the clamping plate to the plate of the adapter may be attached in a position rotated by 180-degrees.

According to still another embodiment of the invention, the plate of the adapter is supported between the two columns movable horizontally against two compression springs, so that, upon tightening of the clamping element of the rule carrier, the abutting surface of the hollow profile of the stop rule is pressed fixedly against the two columns mounted on the rule carrier.

BRIEF DESCRIPTION OF THE DRAWINGS

Further advantages and details of the invention are evident from the description below of an exemplifying embodiment that is depicted in the drawings, in which.

DETAILED DESCRIPTION OF A PREFERRED EMBODIMENT OF THE INVENTION

Figure 2:
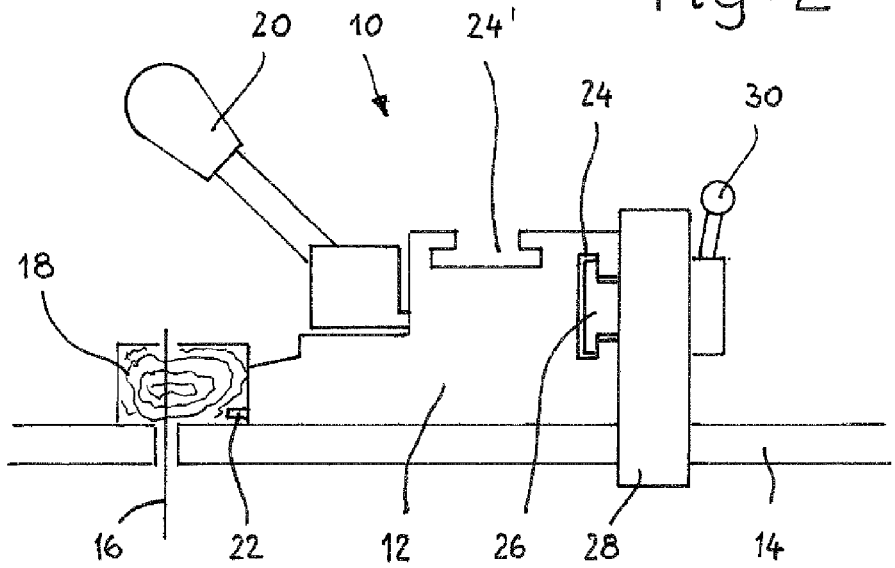
FIG. 2 is a frontal view, corresponding to FIG. 1, of the stop rule that is fastened on the rule carrier without an adapter.

FIG. 2 is a schematic frontal view of a stop rule 10, which is embodied in accordance with EP 1 851 017 A1 by Applicant and which has a hollow profile 12 fastened on machine table 14 of a table saw. In the depicted example, stop rule 10 is fastened on machine table 14 in a laid-down position, when saw blade 16 of the table saw is employed for the processing of low and narrow wooden strips 18 that are advanced by an advance finger 22 by means of a slide 20 integrated into stop rule 10.

Hollow profile 12 of stop rule 10 has two C-shaped longitudinal grooves 24, 24', offset 90 degrees from one another, for the engagement of clamping element 26 that is provided, adjustably in a horizontal direction, on a rule carrier 28. Rule carrier 28 is mounted on machine table 14 in a manner not further depicted, and is equipped with an adjusting lever 30 in order to pull in clamping element 26 by way of an adjusting rod 32 (not visible in FIG. 2, see FIG. 1) and thereby to pull hollow profile 12 of stop rule 10 fixedly against rule carrier 28.

Figure 3:
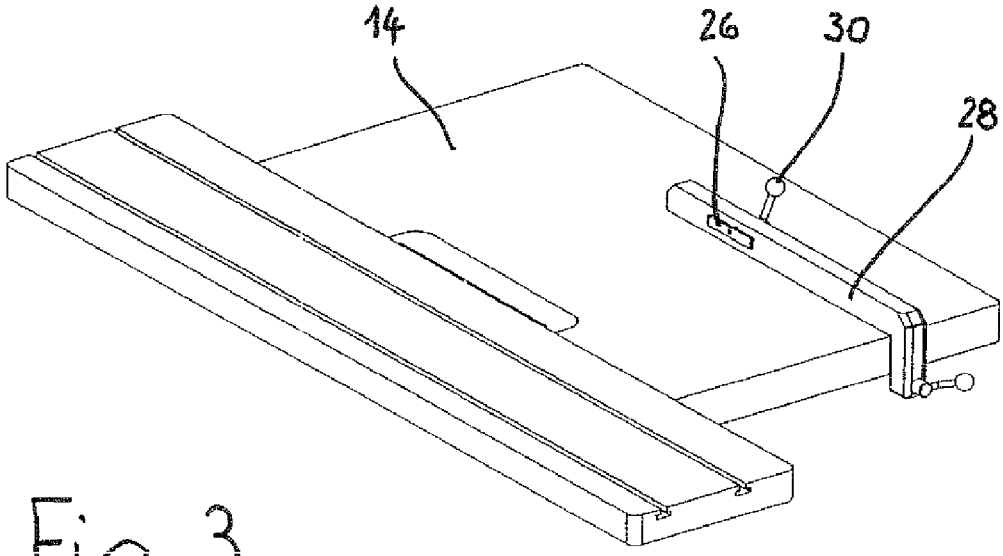
FIG. 3 is a view of a machine table of a table saw, with a rule carrier having a clamping element located vertically approximately at the center.
Figure 4:
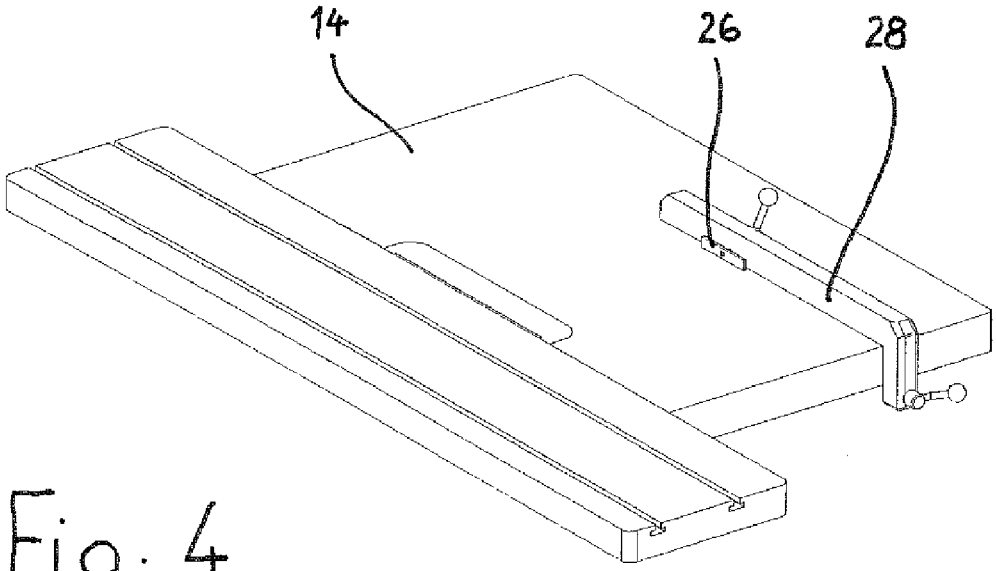
FIG. 4 is a depiction, corresponding to FIG. 3, with a rule carrier having a clamping element attached as low as to rest on the machine table.

As mentioned earlier, a large number of circular saws are equipped with rule carriers that differ from the standard position and standard size of clamping element 26 shown in FIG. 2. For example, as shown in FIG. 3, rule carrier 28 can have a clamping element 26 that is provided at approximately half the height of rule carrier 28, whereas in the example of FIG. 4 clamping element 26 is attached farther down and rests with its lower edge on machine table 14. Adapter 34 is depicted schematically and partly in section in FIG. 1, which is shown in perspective in FIGS. 5 and 6 in two different utilization positions, and is provided in order to create, for these and further variants, the possibility of fastening stop rule 10 on rule carrier 28. This adapter 34 has a rectangular plate 36 made of metal, from front side 38 of which, facing toward stop rule 10 (see FIGS. 7 and 8), projects a clamping bar 40, T-shaped in cross section and having a cross section that corresponds to longitudinal groove 24. The shape and dimensions of this clamping bar 40, therefore, correspond to clamping element 26 of FIG. 2. As FIGS. 5 and 6 further show, plate 36 is supported between two columns 42 that are mounted on rule carrier 28, via two screws in each case (not depicted) having pass-through holes 44 that can be clearly seen in FIGS. 5 and 6, in such a way that they receive between them the clamping element 26.

Figure 1:
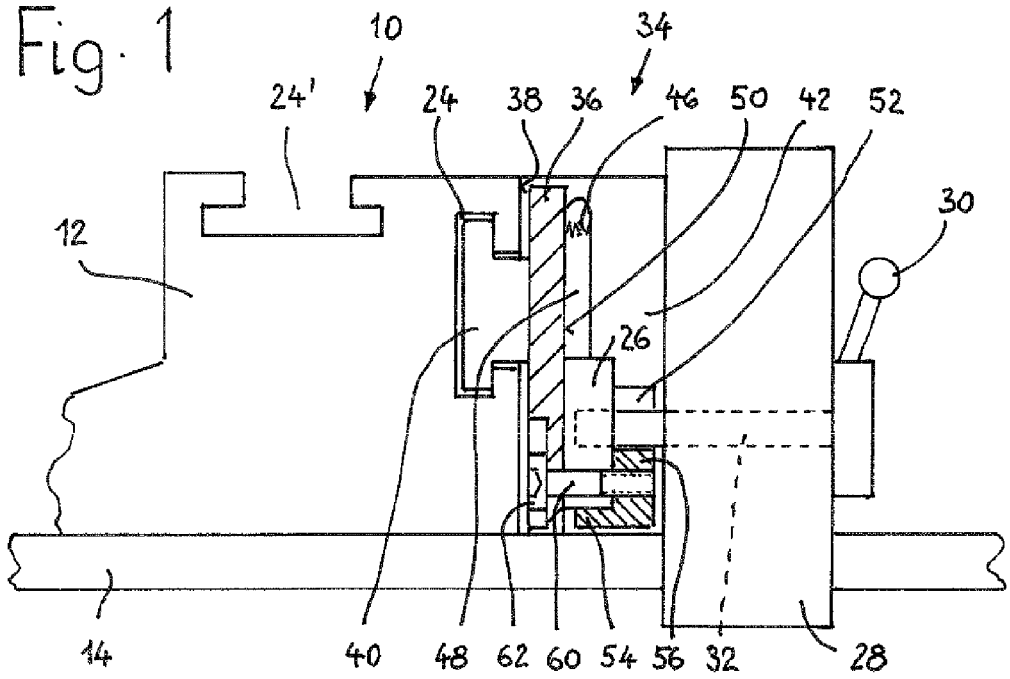
FIG. 1 is a schematic, partly sectioned frontal view of a stop rule that is attached to a rule carrier by way of an adapter according to the invention.
Figure 6:
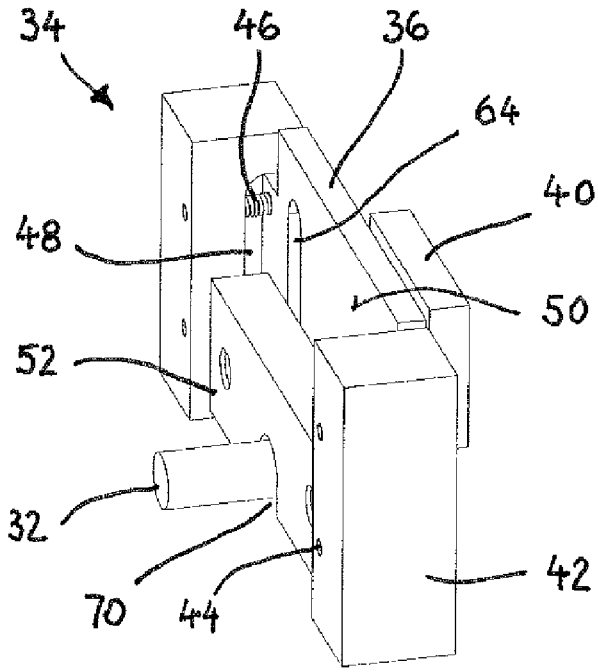
FIG. 6 is a depiction, corresponding to FIG. 5, of an adapter for fastening a clamping element attached in a bottom position, similarly to FIG. 4.

As FIGS. 1 and 6 show, plate 36 is braced on both sides, by way of an upper compression spring 46 and a lower compression spring concealed in the Figures, in a vertically oriented cutout 48 of the respective column 42.

A clamping plate 52 is arranged opposite to back side 50 of plate 36 and has a width, measured in a horizontal direction, corresponding to the width of plate 36. As indicated in FIG. 1, this clamping plate 52 has an L-shaped cross section with a short horizontal limb 54 and a longer vertical limb 56. Screwed releasably into two threaded holes 58 of clamping plate 52 are two screws 60 that connect clamping plate 52 to plate 36. The cylindrical heads 62 of the two screws 60 each engage into an elongated hole 64 that extends in a vertical direction, and are recessed into a step-shaped cutout 66 of the respective elongated hole 64 so that their end face is flush with front side 38 of plate 36.

A receiving space 68 for clamping element 26 of rule carrier 28 is created between back side 50 of plate 36 and clamping plate 52, this receiving space 68 being delimited laterally by the two screws 60. For the case in which the plate-shaped clamping element 26 of rule carrier 28 is wider than said receiving space 68, clamping element 26 must be correspondingly shortened; this is easily possible using an ordinary parting tool.

Figure 5:
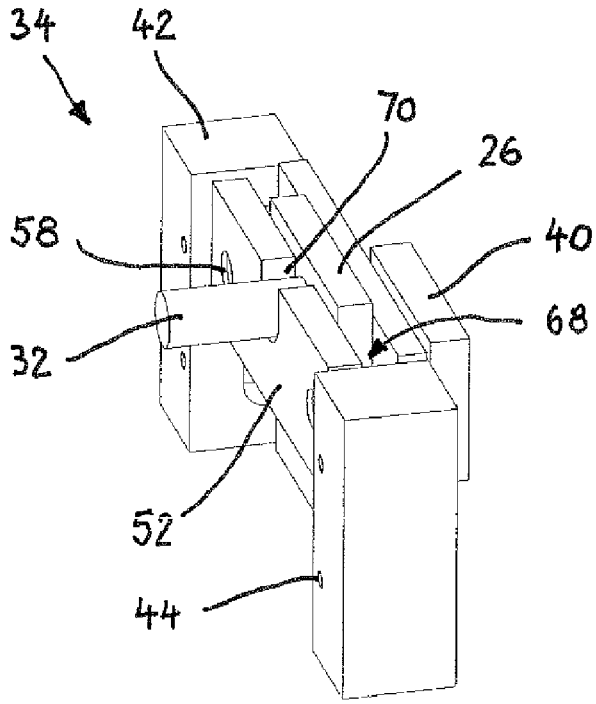
FIG. 5 is a perspective depiction of an adapter according to the invention for receiving a clamping element of a rule carrier provided in a top position.

A comparison of FIGS. 5 and 6 shows that after the two screws 60 are released, clamping plate 52 can be rotated 180 degrees and then bolted back onto plate 36 in the rotated position. All vertical positions of the clamping elements 26 of commercially usual rule carriers 28 can thereby be accommodated.

Lastly, FIGS. 5 and 6 show that a receiving groove 70 for adjusting rod 32 of rule carrier 28 is recessed centeredly into the longer limb 56 of clamping plate 52.

Figure 7:
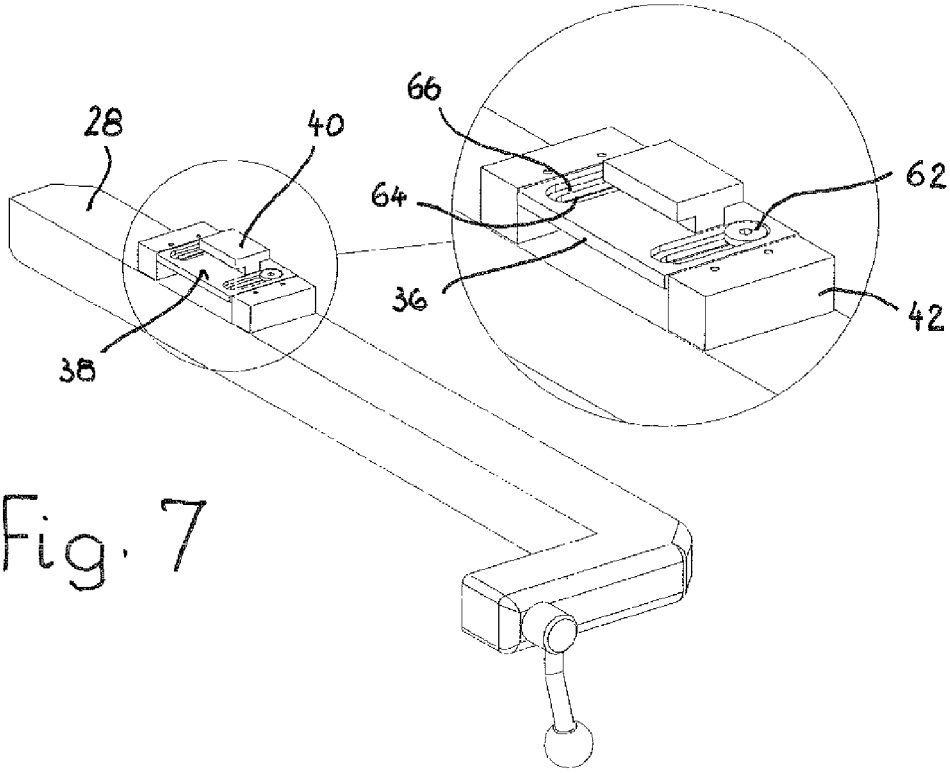
FIG. 7 shows the adapter depicted in FIG. 5, after it has been fastened on a rule carrier.
Figure 8:
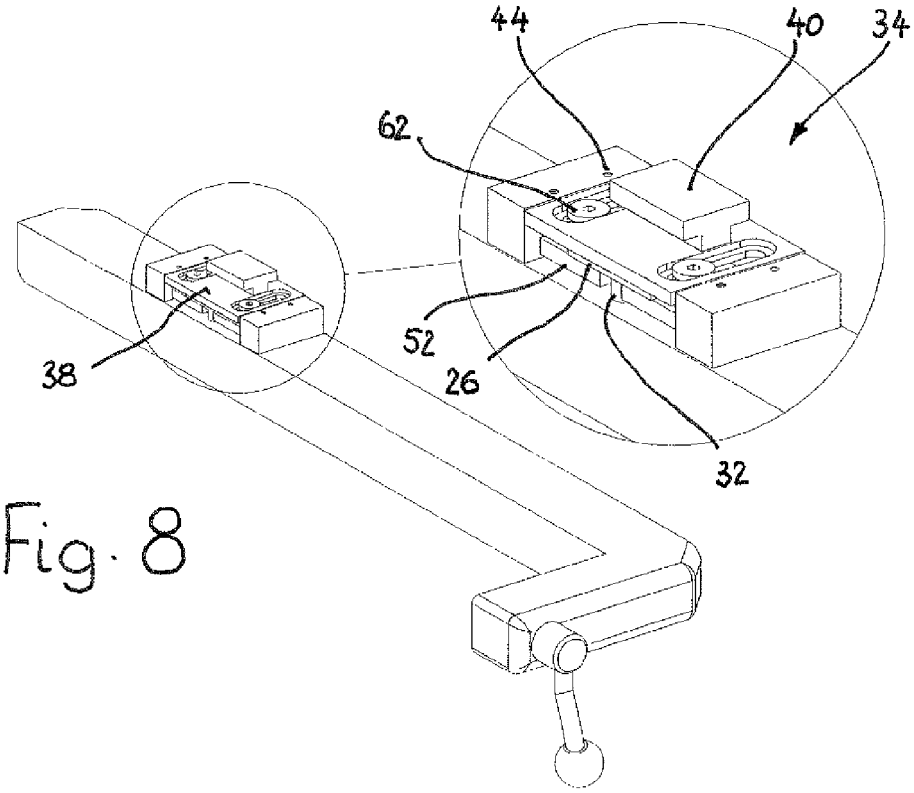
FIG. 8 is a depiction, corresponding to FIG. 7, according to which the adapter shown in FIG. 6 is attached to the rule carrier in order to receive a clamping element attached in a bottom position, similarly to FIG. 4.

FIGS. 7 and 8 show the installation of adapter 34 onto two rule carriers 28, whose clamping element 26 is attached in different positions. The situation shown in FIG. 7 corresponds to FIG. 5, while in FIG. 8 adapter 34 is shown in the lower position of clamping plate 52. In both cases, adapter 34 is first attached on the corresponding side of rule carrier 28 by bolting the two columns 42, by way of screws (not depicted), for which pass-through holes 44 are provided, fixedly onto rule carrier 28.

Figure 9:
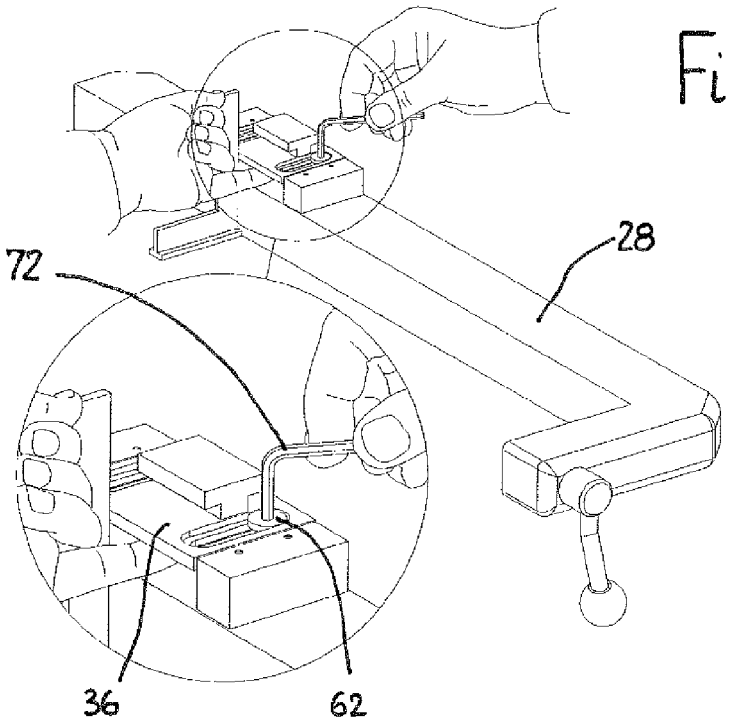
FIG. 9 shows the detail view depicted in FIG. 7 upon tightening of a clamping element in the adapter.
Figure 10:
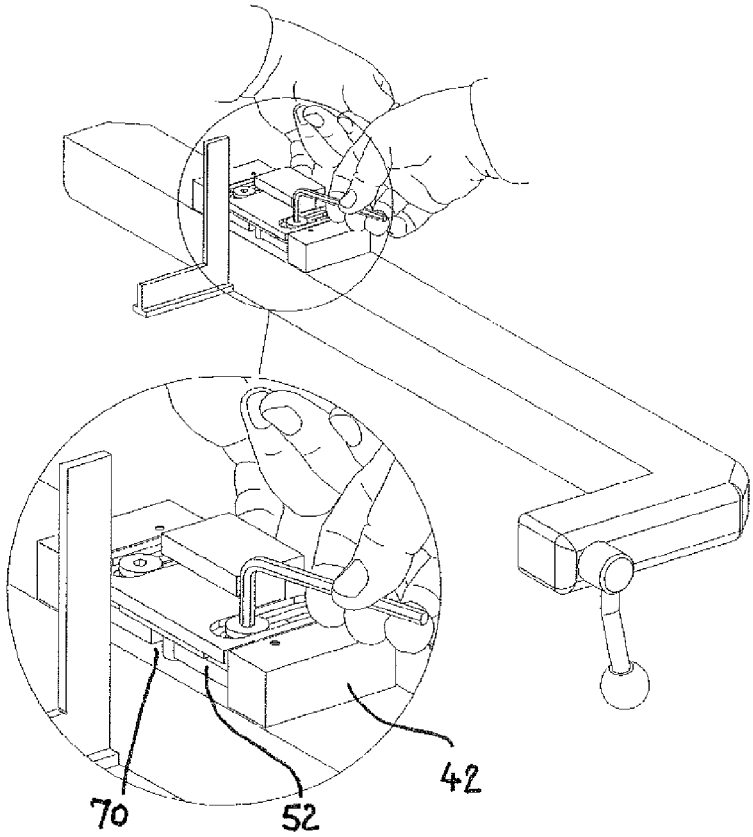
FIG. 10 is a depiction, corresponding to FIG. 9, in the context of tightening a clamping element in the position shown in FIG. 8.

FIGS. 9 and 10 show the continuation of the installation operation, in which, with screws 60 loosened, clamping plate 52 is pressed with its lower limb 54 against clamping element 26 of rule carrier 28, whereupon screws 60 are then tightened using an Allen wrench 72.

Figure 11:
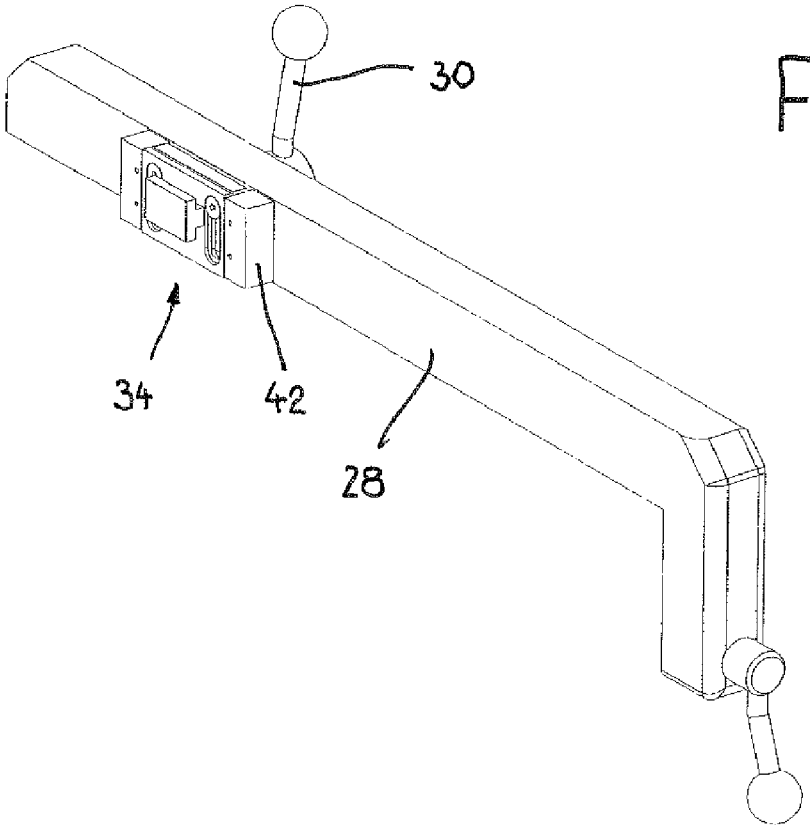
FIG. 11 shows an adapter according to the invention, completely installed in accordance with FIG. 9.
Figure 12:
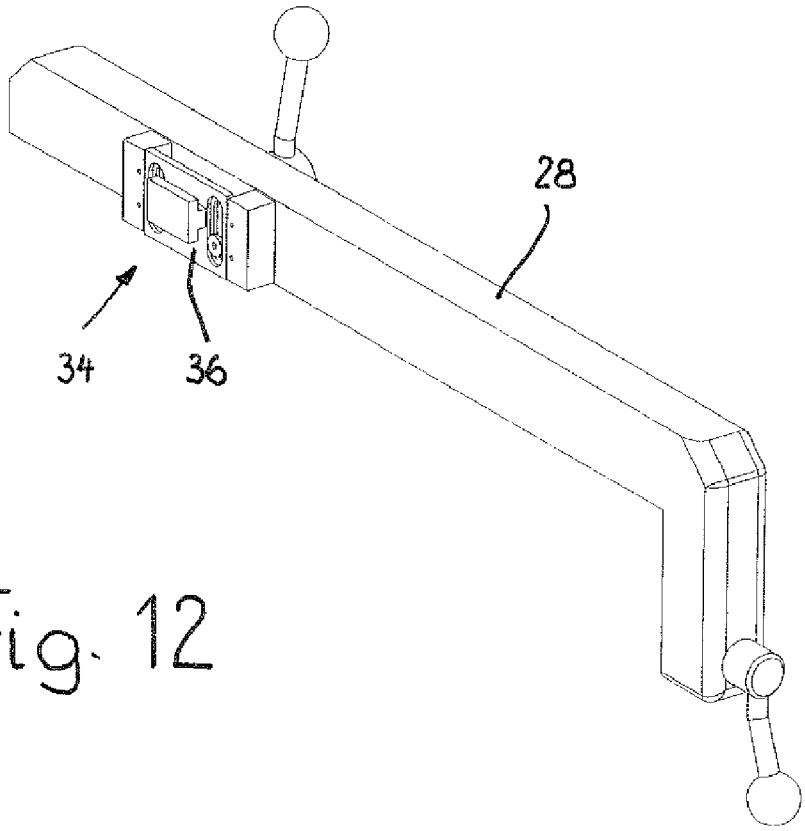
FIG. 12 is a view of the rule carrier according to FIG. 10 with the adapter completely installed.
Figure 13:
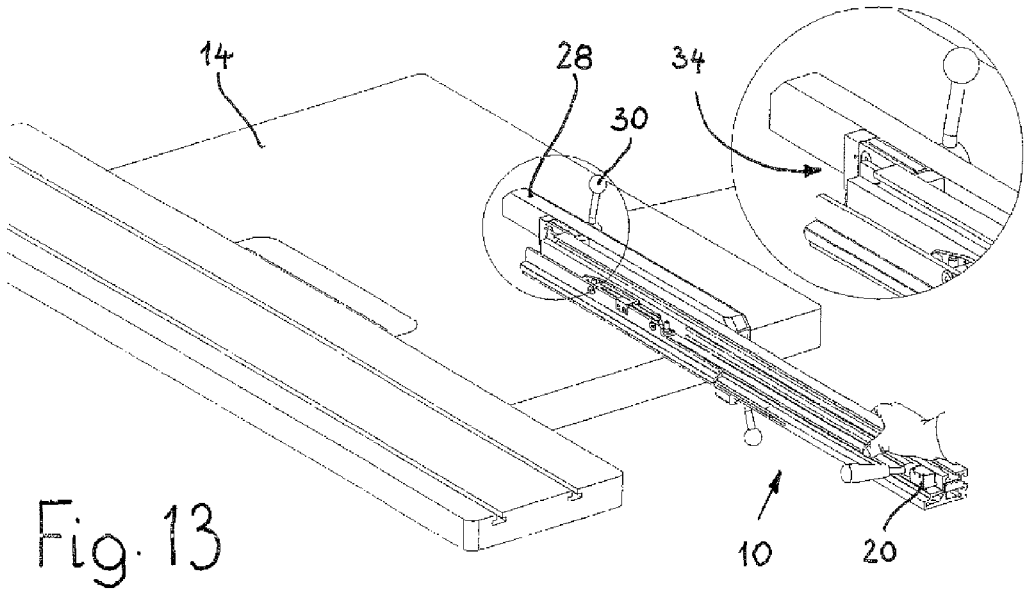
FIG. 13 is a view of a stop rule being slid onto an adapter according to FIG. 11.
Figure 14:
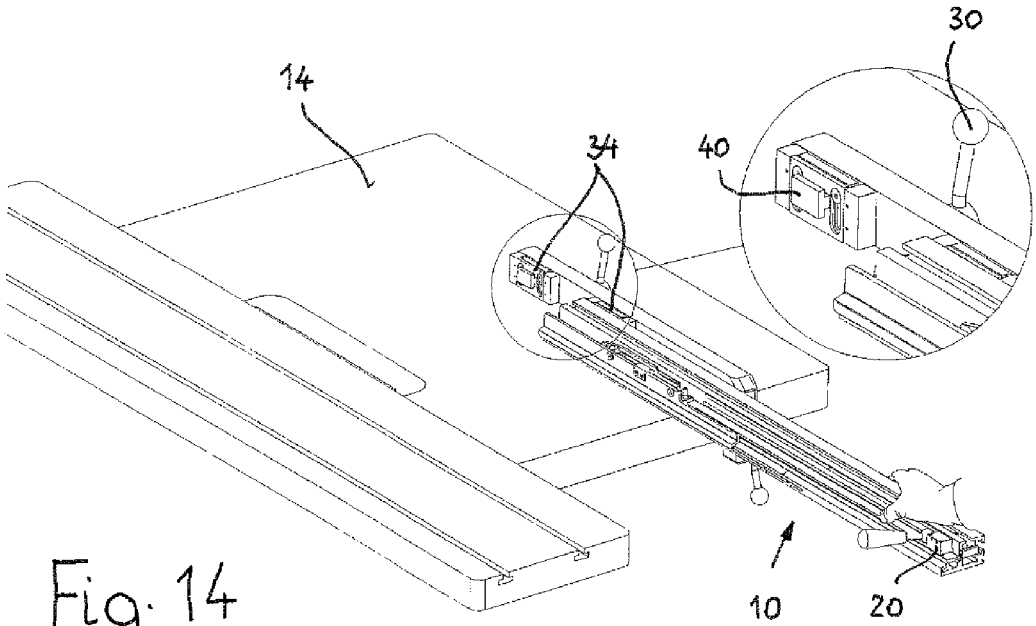
FIG. 14 shows a variant of FIG. 13, in which the rule carrier is fitted with two clamping elements, each of which has an adapter associated with it.

Rule carrier 28 is then swung into its upright working position shown in FIGS. 11 and 12, and mounted on machine table 14. In this position, as shown in FIGS. 13 and 14, stop rule 10 can now be set in place, and for this purpose its longitudinal groove 24 (see FIG. 1) is slid onto clamping bar 40 (FIG. 13) or onto the two clamping bars 40 (cf. FIG. 14).

Clamping element 26 is then pulled toward rule carrier 28 via adjusting bar 32, by pivoting adjusting lever 30. Because the rule carrier is clamped by screws 60 that are now tightened, between back side 50 of plate 36 and the long limb 56 of clamping plate 52, in the context of this movement clamping bar 40 is carried along and pulls stop rule 10, against the force of compression springs 46 and fixedly against the oppositely located surfaces of the two columns 42.

What is claimed is:

1. An apparatus for mounting a stop rule on a machine table of a table saw comprising:

an adapter comprising, a support plate, on one side of the adapter, a clamping bar protruding from the support plate, the clamping bar being shaped to engage a longitudinal groove of the stop rule, a plurality of parallel columns supporting the support plate carrying the clamping bar, on an opposite side of the adapter, a clamping plate adjustable along a longitudinal direction of the plurality of columns, and a clamping element interposed between the support plate and the clamping plate, the clamping plate clamping the clamping element fixedly against a rear side of the support plate; and a carrying member having an adjusting rod extending therefrom, the plurality of columns being fastened on the carrying member, the adjusting rod supporting the clamping element.

2. The apparatus of claim 1, wherein the clamping plate is connected to the support plate with one or more releasable screws that are guided in vertically adjustable fashion in two vertical elongated holes of the support plate.

3. The apparatus of claim 2, wherein the one or more screws are two screws having a clearance therebetween that delimits a receiving space for the clamping element.

4. The apparatus of claim 3, wherein the clamping plate has an L-shaped cross section having a shorter horizontal limb and a longer vertical limb, a receiving groove being centeredly recessed in the longer limb to receive the adjusting rod.

5. The apparatus of claim 4, wherein the clamping plate is coupled to the support plate and is rotatable for 180 degrees in relation to the support plate.

6. The apparatus of claim 1, wherein the support plate is supported between the plurality of columns and is movable against compression springs.

7. The apparatus of claim 1, wherein the plurality of columns are two columns.

* * * * *